United States Patent [19]

Iseki

[11] Patent Number: 4,691,921

[45] Date of Patent: Sep. 8, 1987

[54] AUTOMATED GAME PANEL

[75] Inventor: Takeo Iseki, Tokyo, Japan

[73] Assignee: Tomy Kogyo Co., Inc., Tokyo, Japan

[21] Appl. No.: 923,282

[22] Filed: Oct. 27, 1986

[30] Foreign Application Priority Data

Nov. 8, 1985 [JP] Japan ..... 60-171748[U]

[51] Int. Cl.[4] ..... A63F 7/06

[52] U.S. Cl. ..... 273/85 B

[58] Field of Search ..... 273/85 B, 85 F

[56] References Cited

U.S. PATENT DOCUMENTS

| | | | |
|---|---|---|---|
| 3,475,028 | 10/1969 | Rodorigo et al. | 273/85 B |
| 4,146,224 | 3/1979 | Deutsch | 273/85 B |

FOREIGN PATENT DOCUMENTS

| | | | |
|---|---|---|---|
| 3224541 | 2/1984 | Fed. Rep. of Germany | 273/85 B |
| 1557316 | 1/1969 | France | 273/85 B |
| 642845 | 7/1962 | Italy | 273/85 B |

*Primary Examiner*—Paul E. Shapiro

*Attorney, Agent, or Firm*—Staas & Halsey

[57] ABSTRACT

An automated game panel providing manual and automatic movement of player dolls so as to simulate realistic player movement. An operational handle enables a game player to manually rotate the player dolls, and to initiate automatic forward and reverse motion of the player doll.

11 Claims, 6 Drawing Figures

AUTOMATED GAME PANEL

BACKGROUND OF THE INVENTION

The present invention relates to an automatic game panel, and more particularly to an automated soccer game panel, wherein, for example, the running movement of a player doll is effected without directly manipulating the player doll. The present invention, however, is not limited to a soccer game panel and is equally applicable to other sports games such as hockey.

In one conventional soccer game panel, pairs of kicking levers arranged on a panel surface which forms a soccer field. This conventional soccer provides a relatively simple game wherein the operation of the kicking levers is regarded as the kicking action of the individual soccer player dolls. By manipulating the kicking levers the corresponding player doll hits a ball on the soccer field. A game player scores when the ball enters an opponent's goal.

In another conventional soccer game panel, a plurality of slits are formed on a panel surface which forms a soccer field. In this panel, a player doll is slidably mounted with respect to the slits. Operational levers are provided for moving each of the player dolls along the corresponding slits and to rotate the players about an axis normal to the playing surface. This game, also includes corner kick action wherein corner kicks are simulated at each of the four corners of the panel surface. This second conventional soccer game panel provides a game player with more of a feeling of action, because each of the player dolls is moved forward or rearward by pushing or pulling the operational levers, and the ball is "kicked" by rotating the operational levers so as to rotate the corresponding player dolls. Consequently, the second conventional soccer panel is considerably more desirable than the first conventional panel.

However, in the second conventional soccer panel forward and rearward motion of a player doll requires that an operational lever be pushed or pulled by an amount corresponding to the desired movement of the player doll. In addition, while pulling or pushing the operational levers, a game player must be able to rotate the operational lever so as to impart the desired rotation to the corresponding player doll. Such manual manipulations must be carried out for each of the player dolls on a game player's team (for example, six players). Since operation of each of the operational levers for the six players must be quickly operated during the course of a game, operation of such a conventional soccer game panel is difficult, but provides a challenge. Due to the difficult and troublesome task of simultaneously attempting to operate each of the levers for the player dolls, a game player is likely to miss chances to score. This significantly detracts from the enjoyment of the game and tends to build frustration in a game player due to apparent clumsy manipulation of the operational levers.

The above two conventional soccer game panels are respectively disclosed in Japanese Utility Model Publication Nos. 55-294 and 57-19180.

SUMMARY OF THE INVENTION

It is an object of the present invention to provide an automated game panel permitting operation of player dolls without the complicated pulling and pushing of operational levers as in conventional game panels.

It is another object of the present invention to provide a rugged and inexpensive automated game panel enabling quick and easy manipulation of player dolls.

It is a further object of the present invention to provide an automated game panel with automatic forward and rearward movement of player dolls.

To achieve the above and other objects of the present invention, the automated game panel of the present invention includes a casing having an upper portion with a surface having slits formed therein, and a lower portion; power means, mounted within the casing, for generating a drive force; rotating means for manually rotating the player dolls about an axis normal to the surface; manual input means for receiving a manual input and for providing the drive force in response to the received manual input; and movement means for automatically moving respective ones of the player dolls along corresponding slits in response to the drive force provided by the manual input means.

In a preferred embodiment of the present invention the power means comprises, for example, a dc electric motor powered by, for example, batteries. The rotating means comprises an operational handle which can be rotated and the rotation of the handle transmitted to a corresponding player doll which rotates about an axis normal to a player surface.

In a preferred embodiment of the present invention the movement means comprise a slidable support member or carriage mounted within the casing and having mounted thereon a player doll. The movement means receives a drive force having either a forward direction or a reverse direction, and transmits this force along a shaft which has a worm gear mounted thereon. The worm gear is housed within the slidable support member and engages a rack so that when the worm gear rotates, the slidable support member moves in a forward or rearward direction in dependence upon the forward or reverse drive force received by the movement means. The forward or reverse direction of the drive force provided to the movement means is selected in accordance with a received manual input which causes a crown gear mounted on the shaft of the movement means to rotate in either a clockwise or counter-clockwise direction. The movement means, which automatically moves a player doll in response to a drive force supplied by the manual input means, enables a game player to quickly, easily and automatically move a player doll in either the forward or reverse directions. The cumbersome operation of pulling or pushing an operational lever is thereby eliminated along with the frustration of attempting to manipulate six operation levers for the player dolls on a game players team.

BRIEF DESCRIPTION OF THE DRAWINGS

The accompanying drawings, which are incorporated in and constitute part of the specification, illustrate an embodiment of the present invention, and together with the following description serve to explain the principles of the invention. In the drawings, like reference numerals identify the same or similar parts.

DETAILED DESCRIPTION OF THE PREFERRED EMBODIMENT

Figure 1:
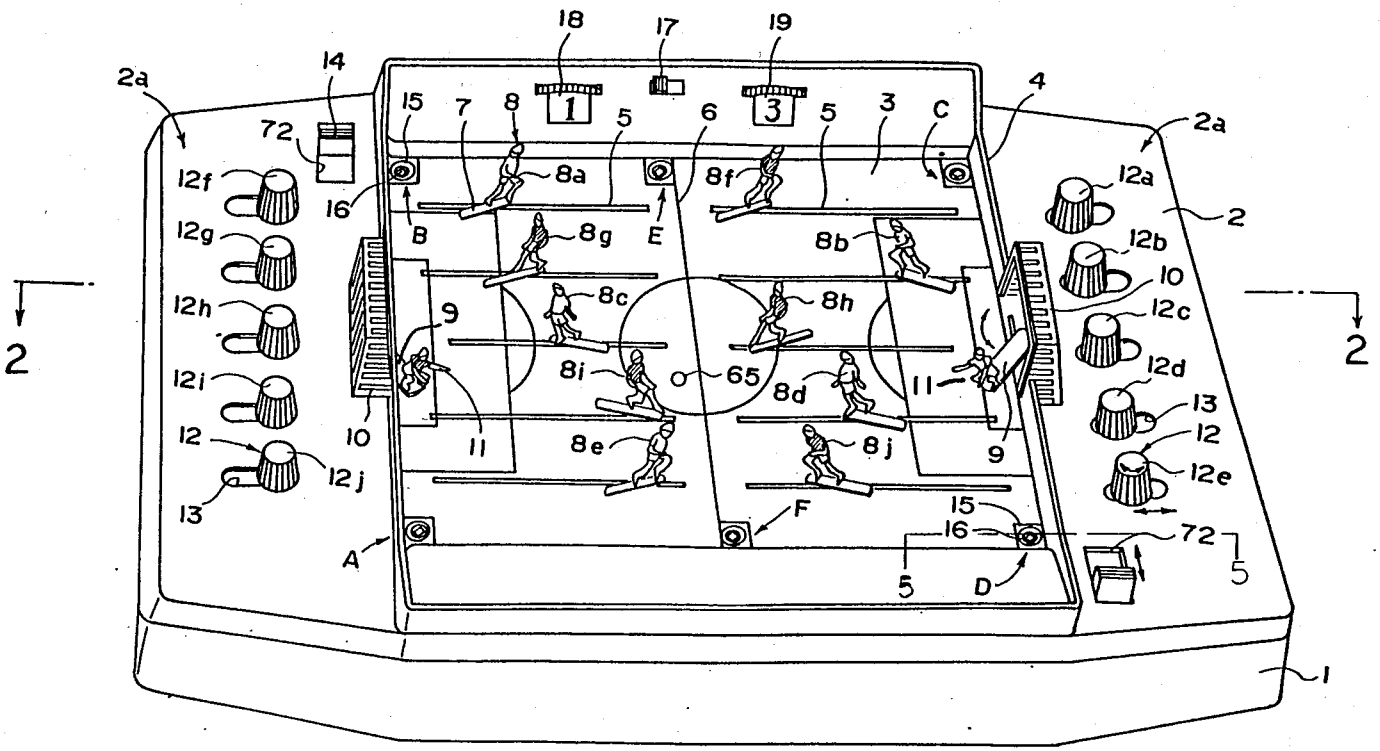
FIG. 1 is a perspective view of an embodiment of the present invention.
Figure 2:
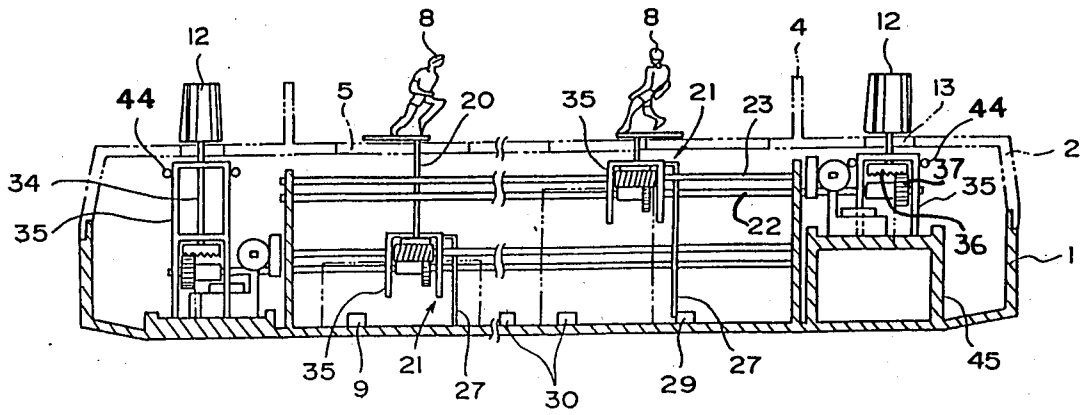
FIG. 2 is a partial cross-sectional view of the FIG. 1 embodiment along the lines 2—2.

FIG. 1 is a perspective view of an embodiment of the present invention, and FIG. 2 is a partial cross-sectional view of the FIG. 1 embodiment along the lines 2—2. Referring to FIG. 1, reference numeral 1 identifies a lower portion of a casing and reference numeral 2 identifies an upper portion of the casing. Reference numeral 3 identifies a surface of the casing configured in the form of a soccer field, with slits 5 formed therein. The soccer field 3 is defined by a frame 4 positioned on the upper portion 2 of the casing. The frame 4 can be mounted on or intergrally formed with the upper portion 2 of the casing.

Reference numerals 2*a* identify operating sections of the automated game panel of the present invention. As shown in FIG. 1, the operational handles 12*a*–12*e* are located in the right hand side operating section and operational handles 12*f*–12*j* are located in the left hand side operating section. Each of the operational hanles 12*a*–12*j* are positioned within respective elongated openings 13. As shown in FIG. 1, parallel slits 5 are arranged on either side of a center line 6. Player dolls 8*a*–8*j* are mounted within corresponding slits 5. Each of the player dolls 8*a*–8*j* is formed with a kick ball lever 7. The player dolls 8*a*–8*j* can rotate about an axis normal to the soccer field 3 and move in the forward and rearward direction within their respective slits 5. Reference numeral 11 identifies the goal keeper dolls mounted on respective defensive plates 9. Operational levers 14 positioned within guide openings 72 on respective operating sections 2*a* enable a game player to move the goal keeper dolls 11.

Figure 5:
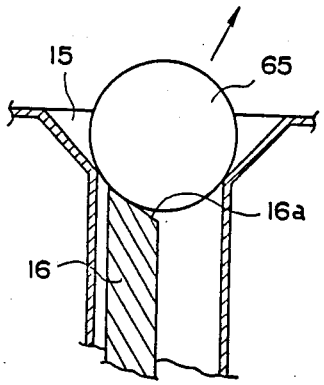
FIG. 5 is a cross-sectional view of a ball receptacle and ball kicking rod of the FIG. 1 embodiment along the line 5—5.
Figure 6:
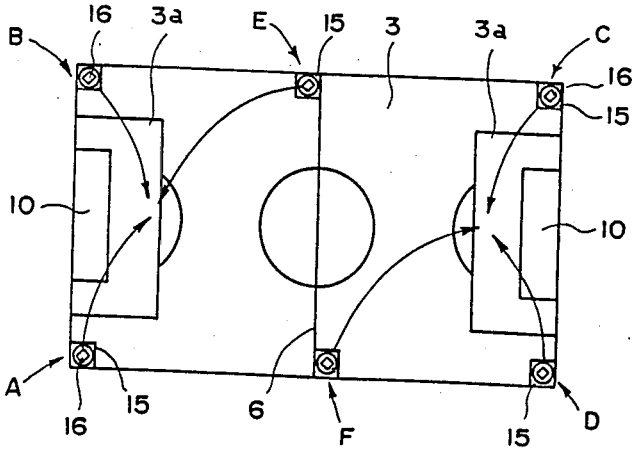
FIG. 6 is a plan view of a playing surface illustrating the directions in which the various ball kicking rods of the FIG. 1 embodiment project a ball.

The soccer field 3 has positioned therein receptacles 15 including ball kicking rods 16 (see also, FIG. 5). If a ball 65 falls into one of the ball receptacles 15, the associated ball kicking rod 16 projects the ball 65 out of the receptacle 15 in a direction such as illustrated in FIG. 6. This simulates throw-in corner kicks. The receptacle 15 and ball kicking rods 16 comprise, together with a mechanism to operate the ball kicking rods 16, a centering mechanism which is described below. A power supply switch 17 applies power to a power means of the present invention such as a dc motor; the power being supplied by, for example, batteries.

With reference to operational handle 12*e* shown in FIG. 1, each of the operational handles 12*a*–12*j* can be rotated in a clockwise or counter-clockwise direction to move the corresponding player doll (e.g., 8*e*) in a clockwise or counter-clockwise direction. Similarly, the operational handle 12*e* can be manually pushed in a forward or rearward direction to cause automatic movement of the corresponding player doll (e.g., 8*e*) in the forward or rearward direction. When not pressed forward to rearward, each of the operational handles 12*a*–12*e* is biased in a neutral position so that the corresponding player doll remains in a fixed position, although capable of being rotated by rotating the corresponding operational handle.

Figure 3:
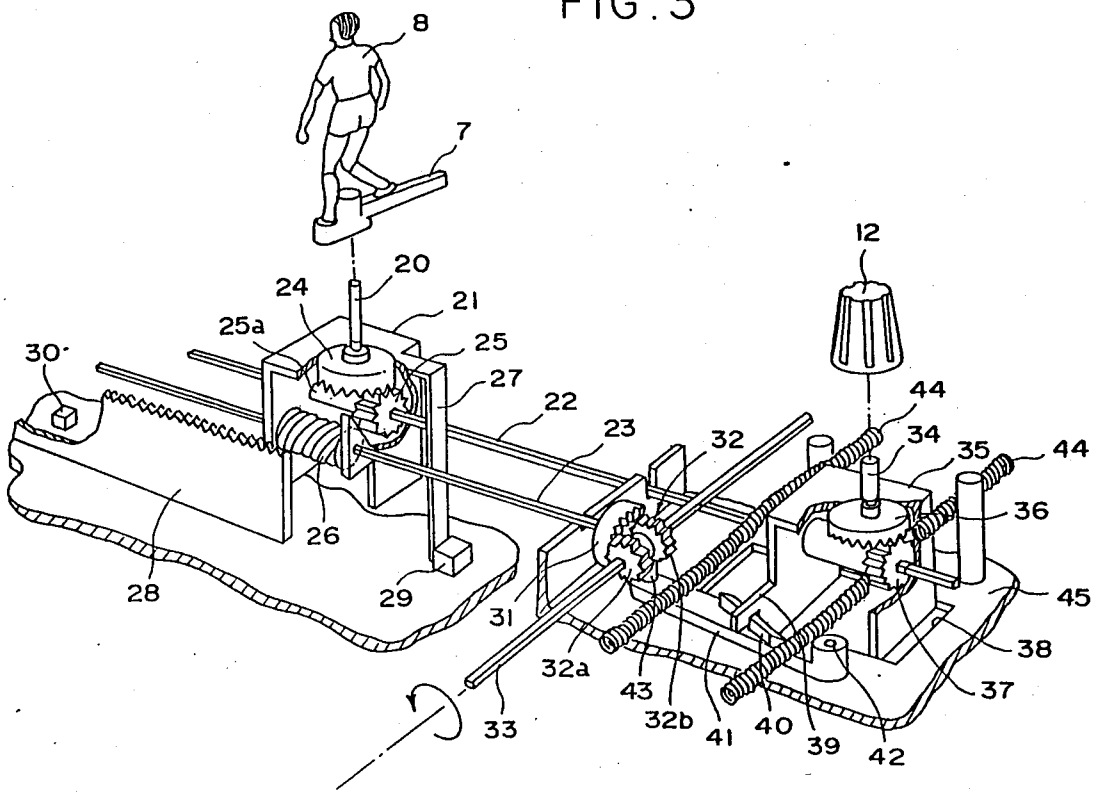
FIG. 3 is a perspective view of the mechanisms in the FIG. 1 embodiment which enable a game player to move a player doll.

Referring to FIGS. 2 and 3, each of the player dolls 8 and associated kick ball levers 7 is mounted on a respective shaft 20. As shown in FIG. 2, the shaft 20 is positioned within a slot 5 and is supported by a carriage including a slidable support member 21. A pair of shafts 22 and 23 extend longitudinally in the direction of the slits 5 and pass through the slidable support member 21. The shafts 22 and 23 have, for example, a polygonal shape so that gears (having a polygonal hole formed therein) mounted thereon rotate together with the corresponding shaft. Referring to FIG. 3, a gear 25 is mounted on the shaft 22 and within the slidable support member 21. The gear 25 slides along the shaft 22 with the slidable support member 21. A collar 25*a* maintains the position of the gear 25 within the slidable support member 21. The gear 25 engages a crown gear 24 housed within the slidable support member 21 and has connected thereto the shaft 20. The shaft 20 can also be integrally formed with the crown gear 34.

A worm gear 26 is slidably mounted on shaft 23. The worm gear 26 is housed within the slidable support member 21 and is positioned so as to engage a rack 28. The rack 28 is mounted on the bottom portion 1 of the casing. As the worm gear 26 rotates in engagement with the rack 28, the slidable support member 21 moves along the longitudinal axis of shaft 23 in either the forward or rearward direction. A projecting member 27 of the slidable support member 21 extends towards the lower portion 1 of the casing and is engagable with a projection or stopper 29 provided on the lower portion 1 of the casing. Projections 29 and 30 are positioned so that movement of the slidable support member 21 is confined to the length of the slits 5 (see, for example, FIG. 2). As a result, the distance between the projections 29 and 30 is substantially the same as the length of the corresponding slit.

The shaft 23 has mounted on one end thereof a crown gear 31. The crown gear 31 is mounted in opposition to a twin gear 32 comprising spaced apart gears 32*a* and 32*b*. The twin gear 32 is mounted on a drive shaft (or distribution shaft) 33 shown in FIG. 3 the twin gear 32 can be engaged with the crown gear 31 so as to impart either clockwise or counter-clockwise rotation to the crown gear 31 and shaft 23, or disengaged from the crown gear 31. Such rotation causes either forward or rearward motion of the corresponding player doll 8. When the twin gear 32 is positioned so that it is disengaged from the crown gear 31, the corresponding player doll 8 remains in a fixed position along the associated slit 5.

The shaft 22 has mounted thereon a transmission gear 37 which is mounted within a supporter 35 such as shown in FIGS. 2 and 3. A crown gear 36 is mounted within the supporter (or control member) 35. The crown gear has mounted thereon a shaft 34 on which an operational handle 12 is mounted. The shaft 34 can be integrally formed with the crown gear 36. The crown gear 36 is mounted so as to engage the transmission gear 37 within the supporter 35. The transmission gear 37 is slidably mounted on the shaft 22 so that when the supporter 35 is moved forward or rearward within a guide groove 38, the transmission gear 37 slides along the shaft 22. As shown in FIG. 2, transmission gear 37 is shaped so that it maintains its engagement with the crown gear 36 within the supporter 35.

Referring to FIG. 3, coil spring 44 biases the supporter 35 in a predetermined neutral position within the guide groove 38. The neutral position of the supporter 35 ensures that the twin gear 32 is disengaged from the crown gear 31, and as a result, the corresponding player doll 8 remains in a fixed position along the associated slit 5.

The supporter 35 is provided with a hook 39 protruding therefrom. The hook 39 engages a guide projection 40 formed on an oscillating lever 41. The oscillating lever 41 pivots about the lower portion 1 of the casing on a pin 42. A pin 43 provided on the oscillating lever 41 is positioned between the gears 32*a* and 32*b* of the twin gear 32. As shown in FIG. 3, the guiding projection 40 mounted on the oscillating lever 41 is positioned at an angle with respect to the longitudinal axis of the oscillating lever 41. As a result, when the operational handle 12 is moved so as to move the supporter 35, the hook 39 forces the oscillating lever 41 (through the sliding action of the guiding projection 40) to move the pin 43 along the longitudinal axis of the drive shaft 33. Because the pin 43 is positioned between the gears 32*a* and 32*b* of the twin gear 32, this motion causes either the gear 32*a* or the gear 32*b* to engage with the crown gear 31. As a result, rotation inparted to the drive shaft 33 can be inparted to the crown gear 31 so as to rotate the crown gear 31 and associated shaft 23 in either a clockwise or a counter-clockwise direction. It will be understood by those skilled in the art that the mechanism illustrated in FIG. 3 is provided for each of the player dolls 8*a*–8*j*.

The supporter 35, oscillating lever 41, pin 43 and twin gear 32 comprise a transmission means for inparting forward or rearward motion to the associated player doll 8. The claimed invention is not limited to such a transmission means, and can incorporate other transmission means including, for example, a pulley or band mechanism, or dual rotating screws which alternately engage the slidable support member 21.

Referring to FIG. 2, the operating mechanisms for the player dolls on the right side and those for the player dolls on the left side of the automated game panel are positioned at different vertical levels within the casing. Specifically, the operating mechanisms for moving the player dolls on the left side of the automated game panel are arranged at a lower level than those for the player dolls at the right side of the automated game panel. For example, on the left hand side of the panel the shaft 20, which supports the player doll 8, and the shaft 34, which supports the corresponding operational handle 12, are longer than the corresponding elements on the right hand side of the automated game panel. This is because, for example, the supporter 35 on the right hand side of the automated game panel is positioned on a support 45 which forms a part of the lower portion 1 of the casing. In a similar manner, the projecting member 27 of the slidable support member 21 on the right hand side of the automated game panel is significantly longer than the corresponding element on the slidable support member 21 on the left hand side of the automated game panel.

Figure 4:
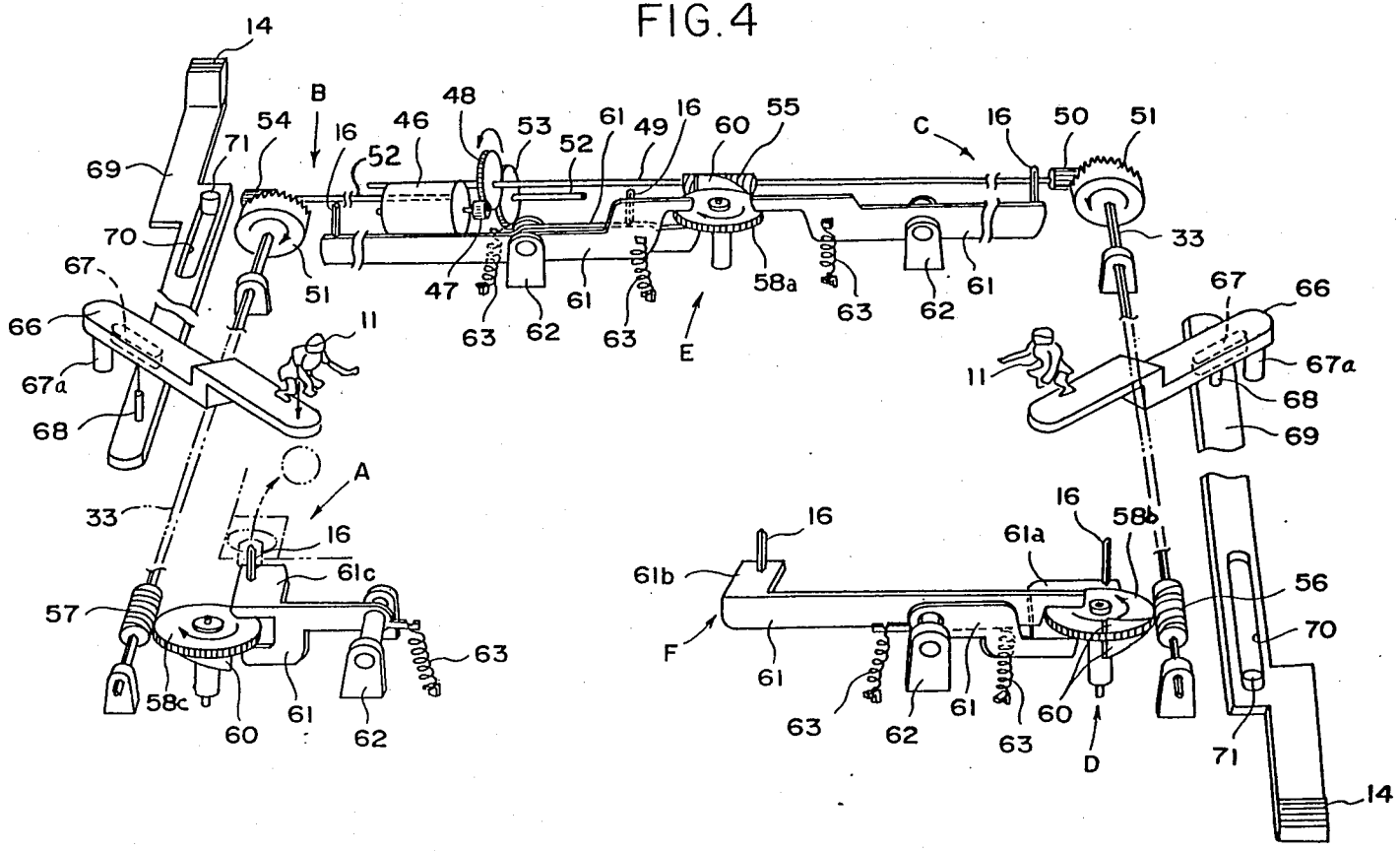
FIG. 4 is a perspective view of the mechanism in the FIG. 1 embodiment which distributes the drive force about the game panel and provides the automatic simulated throw-ins and corner kicks.

FIG. 4 is a perspective view of the mechanism in the FIG. 1 embodiment which distributes the drive force about the game panel and provides the automatic simulated throw-ins and corner kicks. A motor 46 provides a drive force to an output gear 47. The output gear 47 drives a distribution gear 48 which engages a distribution gear 53. The distribution gears 48 and 53 are respectively mounted on distribution shafts 49 and 52 as shown in FIG. 4. The distribution shaft 49 extends to a corner of the automated display panel identified as C in FIG. 4, and has mounted thereon a distribution gear 50. The distribution gear 50 engages a distribution crown gear 51 mounted on the drive shaft 33 at the right hand side of FIG. 4. The distribution gear 48 engages the distribution gear 53 to drive distribution shaft 52. The distribution shaft 52 extends to the corner of the automated game panel identified as B in FIG. 4, and has mounted thereon distribution gear 54. The distribution gear 54 engages a distribution crown gear 51 mounted on the drive shaft 33 shown on the left hand side of FIG. 4. With this arrangement, when the motor 46 rotates the output gear 47, the drive force is transmitted via distribution gears 48 and 53 to respective distribution shafts 49 and 52 to cause rotation of the drive shafts 33 on both sides of the automated game panel as shown in FIG. 4.

FIG. 4 also illustrates a centering mechanism which simulates throw-ins and corner kicks. The centering mechanism is driven by the drive force provided by the motor 46. The automated game panel of the present invention includes ball receptacles 15 (FIG. 5) located at each of the corners of the soccer field 3 and which are identified as A, B, C, D, and F in FIGS. 1 and 6. The ball receptacles 15 are formed to receive a ball 65 and have positioned therein a ball kicking rod 16 as detailed in FIG. 5. The upper portion 16*a* of the ball kicking rod 16 is sloped such that when the ball 65 is kicked out of the ball receptacle 15, the ball will be projected in a particular direction such as illustrated in FIG. 6. Specifically, when the ball is kicked out of the ball receptacles 15 identifies as A, B and E in FIG. 6, the ball is projected toward a goal area 3*a* at the left hand side of the soccer field 3. When the ball 65 is kicked out of the ball receptacles 15 identified as C, D and F in FIG. 6, the ball is projected towards the goal area 3a at the right hand side of the soccer field 3.

Referring to FIG. 4, the motor 46 provides the drive force for the centering mechanism. Specifically, the drive force from the motor 46 is transmitted to a centering worm gear 55 mounted on the distribution shaft 49, and to centering worm gears 56 and 57 respectively mounted on the drive shafts 33. In FIG. 4, a worm wheel 58*a* engages centering worm gear 55, a worm wheel 58*b* engages centering worm gear 56 and a worm wheel 58*c* engages centering worm 57. The respective worm wheels have mounted thereon cams 60.

The centering mechanism associated with the ball receptacle identified at A in FIG. 4 includes a lever 61 having a forked plate 61*c* connected to one end of a lever 61. The other end of the lever 61 has connected thereto a spring 63 which biases the associated ball kicking rod 16 so that it protrudes towards the top of the associated ball receptacle 15. As the worm wheel 58*c* is rotated by the centering worm gear 57, the cam 60 on worm wheel 58*c* engages the lever 61 so as to cause the associated ball kicking rod 16 to receed into the associated ball receptacle 15. Because the cams 60 have a generally triangular shape, the associated ball kicking rod 16 gradually receeds into the ball receptacle 15, and then snaps upwardly to project the ball 65 out of the ball receptacle 15.

The ball kicking rods within the ball receptacles 15 at locations B, C and E are each driven by centering worm gear 55 and worm wheel 58*a*. The operation of these ball kicking rods is similar to that of the centering mechanism associated with the ball kicking rod 16 at location A. Specifically, springs 33 bias the ball kicking rods so that they protrude towards the top of the respective ball receptacles 15. As the cam 60 mounted on worm wheel 58*a* alternately engages the respective levers 61, the associated ball kicking rods 16 gradually receed into the associated ball receptacle 15, and then snap upwardly to project the ball out of the ball receptacle 15.

The centering mechanism associated with the ball receptacles identified at locations D and F is illustrated in the lower right hand portion of FIG. 4. The worm wheel 58*b* has mounted thereon two cams 60. As illustrated, the cams are mounted so as to oppose each other. The cams, however, need not oppose each other on the worm wheel 58*b*. The kicking ball rod 16 associated with the position F is mounted on a portion 61*b* of lever 61, while the kicking ball rod 16 associated with the position D is mounted on a portion 61*a* of another lever 61. As with the other centering mechanisms, springs 63 bias the associated kicking ball rods 16 towards the top of the respective ball receptacles 15. As the cams 60 engage the levers 61, the kicking ball rods 16 gradually receed into the respective ball receptacles 15, and then due to the triangular shape of the cams 60, snap upward to project the ball 65 out of the ball receptacle 15 containing the ball.

FIG. 4 illustrates the mechanism for operating goal keeper dolls 11. Since the mechanism is the same for each of the goal keeper dolls 11, the following description applies to both the goal keeper dolls. A lever 66 has mounted on one end thereof a goal keeper doll 11, and has formed on the other end thereof a pin 67*a*. The lever 66 pivots about the pin 67*a* which engages a portion of the casing (not shown). The lever 66 has formed therein, a slot 67 which accepts a pin 68 formed on a lever 69. The lever 69 has formed therein a slot 70 which accepts a guide pin 71 formed on the casing. The lever 69 has formed on one end thereof the operational lever 14 which is positioned within the guide opening 72 (shown in FIG. 1). The guide lever 69 thus moves in a direction parallel to the longitudinal axis of the drive shaft 33. By moving the lever 69 via the operational lever 14, the goal keeper doll 11 is rotated due to the oscillating action of the lever 66 and pin 68 within the slot 67.

In the embodiment of the present invention as described above, when power is provided to the motor 46 via the power supply switch 17, the output gear 47 drives the distribution gears 48 and 53 so as to rotate the corresponding distribution shaft 49 and 52. This causes the drive shafts 33 shown on the right and left hand sides of FIG. 4 to rotate, and causes the centering worm gears 55, 56 and 57 to rotate. As a result, the corresponding worm wheels 58*a*, 58*b* and 58*c* rotate, causing the ball kicking rod 16 to move within the associated ball receptacles 15 in the manner described above.

Referring to FIG. 3, rotation of the drive shaft 33 causes the twin gear 32 to rotate. When the operational handle 12 is manually moved forward, the oscillating lever 41 causes one of the gears 32*a* or 32*b* to engage the crown gear 31; and thus, causing the shaft 23 to rotate. Rotation of the shaft 23 causes worm gear 26 to rotate and the slidable support member 21 to move in either the forward or rearward direction depending upon the direction that worm gear 26 rotates. The slidable support member 21 moves in the forward direction until the slidable support member 21 contacts the stopper 30 so as to prevent further forward motion of the slidable support member 21. Similarly, when the operational handle 12 is moved rearward, the oscillating lever 41 causes the twin gear 32 to rotate the shaft 23 so as to move the slidable supporter in a rearward direction. The slidable support member 21 moves in the rearward direction until the projecting member 27 contacts the stopper 29.

While the operational handle 12 is pressed forward or rearward, or while the operational handle 12 is positioned in the neutral position by coil springs 44, the operational handle 12 can be turned in the clockwise or counter-clockwise direction. This causes the shaft 34 to rotate the crown gear 36 and consequently to rotate the transmission gear 37. Rotation of the transmission gear 37 rotates the shaft 22 and the gear 25 positioned thereon. Rotation of the gear 25 causes both the crown gear 24 and shaft 20 to rotate. As a result, the associated player doll 8 rotates in the clockwise or counter-clockwise direction.

With the present invention, game players can enjoy a soccer game without the awkward and difficult task of attempting to simultaneously push and pull, for example, six operational levers as required in conventional games. Game players using the present invention simply manipulate operational handles which provide quick and easy manipulation of player dolls.

What is claimed is:

1. An automated game panel for moving player dolls so as to move an object, comprising:

(a) a casing having an upper portion with a surface having slits formed therein, and a lower portion;

(b) power means for generating a drive force;

(c) rotating means for manually rotating the player dolls about an axis normal to the surface;

(d) manual input means for receiving a manual input and for providing the drive force in response to the received manual input;

(e) movement means for automatically moving respective ones of the player dolls along corresponding slits in response to the drive force provided by said manual input means;

(f) drive means for receiving the drive force from said manual input means, the drive means including (i) a shaft, (ii) a first worm gear mounted on said shaft, (iii) a first crown gear mounted on said shaft, and (iv) a rack mounted on said casing so as to engage said first worm gear; and (g) carriage means, operatively connected to receive the drive force from said drive means, for moving respective ones of the player dolls along corresponding slits in response to the received drive force, the carriage means including a slidable support member slidably mounted on said shaft and having housed therein said first worm gear.

2. An automated game panel according to claim 1, further comprising stopping means, operatively connected to said carriage means, for stopping motion of the player dolls at respective ends of the corresponding slits.

3. An automated game panel according to claim 1, wherein said drive force has a forward direction and a reverse direction, and wherein said manual input means comprises:

a control member movable in response to said received manual input;

transmission means, operatively connected to said control member, for selectively providing to said drive means one of the forward direction drive force, the reverse direction drive and no drive force in accordance with the movement of said control member; and biasing means for biasing said control member in a neutral position so that said transmission means provides no drive force to said drive means in the absence of said manual input.

4. An automated game panel for moving player dolls so as to move an object, comprising:

(a) a casing having an upper portion with a surface having slits formed therein, and a lower portion;

(b) power means for generating a drive force having a forward direction and a reverse direction;

(c) rotating means for manually rotating the player dolls about an axis normal to the surface;

(d) manual input means for receiving a manual input and for providing the drive force in response to the received manual input;

wherein said manual input means includes (i) a control member movable in response to said received manual input, (ii) transmission means, operatively connected to said control member, for selectively providing to said drive means one of the forward direction drive force, the reverse direction drive force and no drive force in accordance with the movement of said control member, and (iii) biasing means for biasing said control member in a neutral position so that said transmission means provides no drive force to said drive means in the absence of said manual input; and (e) movement means for automatically moving respective ones of the player dolls along corresponding slits in response to the drive force provided by said manual input means;

(f) drive means for receiving the drive force from said manual input means, the drive means including (i) a shaft, (ii) a first worm gear mounted on said shaft, and (iii) a first crown gear mounted on said shaft;

(g) carriage means, operatively connected to receive the drive force from said drive means, for moving respective ones of the player dolls along corresponding slits in response to the received drive force, wherein the carriage means includes a slidable support member slidably mounted on said shaft and having housed therein said first worm gear; and (h) a rack mounted on said casing so as to engage said first worm gear.

5. An automated game panel according to claim 4, wherein said power means comprises:

a motor;

first distribution gears operatively connected to said motor;

first distribution shafts operatively connected to respective ones of said first distribution gear;

second distribution gears mounted on ends of said first distribution shafts;

second distribution shafts mounted transverse to said first distribution shafts; and distribution crown gears mounted on respective ones of said second distribution shafts so as to engage respective ones of said second distribution gears.

6. An automated game panel according to claim 5, wherein said rotating means comprises:

first rotation means, housed within said control member, for receiving a manual input and for providing a rotation force varying in accordance with said manual input;

second rotation means, housed in said slidable support member, for rotating a player doll in response to said rotation force received from said first rotation means; and connection means, having slidably mounted thereon said slidable support member and mounted thereon said control member, for transmitting said rotation force between said first and said second rotation means.

7. An automated game panel according to claim 6, wherein said transmission means comprises:

twin gears mounted on one of said second distribution shafts so as to be in opposition to said first crown gear; and sliding means for moving respective ones of said twin gears into and out of engagement with said first crown gear so as to provide said forward direction drive force, said reverse direction drive force and no drive force to said first crown gear.

8. An automated game panel according to claim 6, wherein said casing includes goal areas and said panel further includes:

centering means, mounted within said casing and operatively connected to said power means, for automatically projecting the object towards the goal areas.

9. An automated game panel according to claim 8, wherein said upper portion of said casing has formed therein receptacles having upper and lower portions for receiving the object, and said centering means comprises:

centering worm gears mounted on respective ones of said first and second distribution shafts;

worm wheels mounted so to engage respective ones of said centering worm gears;

cams mounted on respective ones of said worm wheels;

levers mounted so as to engage respective ones of said cams;

kick ball rods mounted on one end of respective ones of said levers and positioned within respective ones of said receptacles; and springs attached to another end of respective ones of said levers so as to bias said kick ball rods in a top portion of respective ones of said receptacles.

10. An automated game panel for moving player dolls so as to move an object, comprising:

(a) a casing having an upper portion with a surface having slits formed therein, a lower portion and goal areas;

(b) power means for generating a drive force;

(c) rotating means for manually rotating the player dolls about an axis normal to the surface;

(d) manual input means for receiving a manual input and for providing the drive force in response to the received manual input;

(e) movement means for automatically moving respective ones of the player dolls along corresponding slits in response to the drive force provided by said manual input means, wherein said movement means includes- (i) drive means for receiving the drive force from said manual input means, (ii) carriage means, operatively connected to receive the drive force from said drive means, for moving respective ones of the player dolls along corresponding slits in response to the received drive force; and (f) centering means, mounted within said casing, and operatively connected to said power means, for automatically projecting the object towards the goal areas.

11. An automated game panel according to claim 10, wherein said upper portion of said casing has formed therein receptacles having upper and lower portions for receiving the object, and said centering means comprises:

centering worm gears mounted on respective ones of said first and said second distribution shafts;

worm wheels mounted so to engage respective ones of said centering worm gears;

cams mounted on respective ones of said worm wheels;

levers mounted so as to engage respective ones of said cams;

kick ball rods mounted on one end of respective ones of said levers and positioned within respective ones of said receptacles; and springs attached to another end of respective ones of said levers so as to bias said kick ball rods in a top portion of respective ones of said receptacles.

* * * * *